US008910430B2

(12) United States Patent
Argiropoulos et al.

(10) Patent No.: US 8,910,430 B2
(45) Date of Patent: Dec. 16, 2014

(54) MINI-WALL PARAPET FOR ROOF EDGING OR COPING

(76) Inventors: John George Argiropoulos, Arlington, VA (US); Thomas John Lynch, Cheverly, MD (US)

( * ) Notice: Subject to any disclaimer, the term of this patent is extended or adjusted under 35 U.S.C. 154(b) by 0 days.

(21) Appl. No.: 13/200,706

(22) Filed: Sep. 29, 2011

(65) Prior Publication Data

US 2013/0081344 A1 Apr. 4, 2013

(51) Int. Cl.

| | |
|---|---|
| ***E04B 7/00*** | (2006.01) |
| ***E04D 3/40*** | (2006.01) |
| ***E04D 13/00*** | (2006.01) |
| ***E04D 13/155*** | (2006.01) |

(52) U.S. Cl.

CPC ..... *E04D 13/155* (2013.01)
USPC ..... 52/96; 52/97; 52/58; 52/300

(58) Field of Classification Search

CPC ... E04D 13/1415; E04D 13/15; E04D 13/155; E04D 13/158; E04D 3/405; E04D 13/1407; E04D 13/1475
USPC ..... 52/58, 60–62, 96, 97, 300
See application file for complete search history.

(56) References Cited

U.S. PATENT DOCUMENTS

| | | | | |
|---|---|---|---|---|
| 3,735,540 | A * | 5/1973 | Thaler | 52/94 |
| 4,037,372 | A * | 7/1977 | Patry | 52/96 |
| 4,071,987 | A * | 2/1978 | Hickman | 52/94 |
| 4,798,033 | A * | 1/1989 | Weidl | 52/94 |
| 5,608,993 | A * | 3/1997 | Argiropoulos | 52/96 |
| 6,101,767 | A * | 8/2000 | Georgeau | 52/62 |
| 6,606,828 | B1 * | 8/2003 | Lin et al. | 52/58 |
| 7,735,267 | B1 * | 6/2010 | Ayers, Jr. | 52/96 |

* cited by examiner

*Primary Examiner* — Brian Glessner
*Assistant Examiner* — Brian D Mattei
(74) *Attorney, Agent, or Firm* — Thomas E. Lynch

(57) ABSTRACT

Mini-wall parapet structures are disclosed. The structures are of one piece sheet metal with four sided, longitudinal members. A cleat extends downwardly from a lower corner of the structure. The cleat may be a single layer of sheet metal or a folded over layer. The cleat engages a coping member at final installation, and provides an additional attachment for the structure. A folded over primary attachment layer extends from the other lower corner of the structure. The attachment layer is of variable width so that different roof surfaces can be accommodated. The cross section of the structure is either square, or rectangular with longer vertical walls. Rectangular structures are used with thicker insulation. A facade extension may be used with rectangular structures. The top wall includes a gravel guard. The hollow void may be further filled with insulation.

20 Claims, 2 Drawing Sheets

MINI-WALL PARAPET FOR ROOF EDGING OR COPING

BACKGROUND OF THE INVENTION

1. Field of the Invention

The present invention pertains generally to an article of manufacture which facilitates the application and sealing of sheet-like membranes, such as rubberized roofing materials, to the outside edges of buildings; more particularly, to a sheet metal mini-wall parapet which replaces prior art parapets which are labor intensive to make and install, and are not as sturdy and long lasting as our invention. The mini-wall parapet of this invention also allows it to be fully prefabricated in the shop of sheet metal, such as galvanized steel, aluminum, stainless steel, or other corrosion resistant metal, without the use of any wood or masonry in the structure.

2. Discussion of the Background of the Invention

Roof edge sealing constructions are referred to in the literature by several names such as mini-wall parapets, coping structures, roof edge assemblies, gravel stop assemblies, water dams, and the like. These devices are provided for the purpose of sealing the outer edges of roof construction components by anchoring the sheet-like roofing membranes to the roof edges. They also serve to retain ballasts, control water drainage, or for supporting fascia members at the interfaces between various constructions and structures. For purposes of this disclosure, we will refer to these devices as mini-wall parapets. In the description of the drawings which follows, all elements in common with prior art FIGS. 1A and 1B, will include the same numbering system insofar as possible. Also, the dimensions of the various elements are not true to scale, and certain portions of the drawings may be depicted as exaggerated in thickness or thinness to facilitate their disclosure.

As indicated by prior art FIG. 1A, edge sealing mini-wall parapet 1, is fabricated on the site at the edge of the roof deck 2 by layering a plurality of wood planks 3 (such as 2×6's or 2×8's), as shown at interface 17. Such a mini-wall parapet 1 is typically formed from so-called pressure treated wood so that it is assured of moisture and insect resistance, but untreated wood can be utilized as well, provided that the wood is well-sealed from moisture and insects by the rest of the structure. If the deck 2 is of concrete or masonry construction, the lowermost wood plank 3 is secured to roof deck 2 by anchor bolts or masonry fasteners 4. If the deck 2 is of wood or metal construction, the lower layer 3 is screwed to the deck. In that case, the fastening elements 4 are screws. Each of the subsequent wood layers 3 are securely nailed to the next lower layer by nails 5. The number of layered planks 3 required is determined by the thickness of the insulation layer 6, whereby the mini-parapet is at least a minimum height above the insulation layer 6.

At the outside top of the typical wood mini-parapet 1, there is provided a triangular element 8 with the hypotenuse of the triangular shape facing the inside of the mini-parapet. Member 8 is also of pressure treated wood, and is nailed (toenail fashion) to the upper wood layer 3 by nails 9. The triangle shaped member 8 is provided as a gravel stop where a gravel ballast is used, and/or to deflect water back toward the roof so that it does not drip excessively over the outside wall of the building.

The roof deck 2 is shown over a conventional outside wall 18, which may be of brick or block or a combination thereof. The roof deck 2 is attached to the outside wall 18 at interface 19 in the conventional manner.

The roof membrane 7 is glued or otherwise installed over the roof insulation layer 6, and continues to lap over the mini-wall parapet 1, over the gravel stop 8, and partially down the outside of the mini-wall parapet as shown. An elongated cleat 11 of corrosion resistant sheet metal is either nailed or screwed by elements 12 laterally along the length of the mini-wall parapet into the lower wood layer 3. The elements 12 can also be masonry attachments if the elongated cleat 11 is installed laterally along the length of concrete roof deck 2 into the outside edge of roof deck 2. See prior art FIG. 1B, and FIG. 2B.

The bottom of the cleat 11 is bent outward slightly as shown at 13, so that a finishing cap or coping member 10 can be resiliently installed. The coping member 10 is also of corrosion resistant sheet metal and includes an inverted flange 16 which snuggly engages the outwardly bent bottom edge 13 of the cleat 11 when installed. The coping member 10 is prefabricated by bending its sheet metal in the shape shown. The coping member 10 and the cleat 16 are sufficiently flexible, as indicated by dotted portion 9, so that they can be elastically deformed when the coping member 10 is snapped over the top of member 8 and the roof membrane 7 when final installation is made. The upper end of the coping member 10 is downwardly bent at 14 so that the upper end fits snuggly over the element 8 and the roof membrane 7. The coping member 10 may have an outwardly bent lip 15. This lip minimizes the possibility that the coping member 10 might snag or even cut the roof membrane 7 when the coping member is installed. The lip 15 also minimizes injury to the installer when the coping member 10 is installed. As noted above, the coping member 10 and the cleat member 11 are sufficiently flexible so that they can be elastically deformed (see dotted depiction at 9) when the coping member 10 is installed over the top of the mini-wall parapet, without exceeding the elastic limit of any of the bends in the coping member 10 or of the cleat 11. Thus when installed, the coping member 10 snaps snugly and permanently over the elements of the mini-wall parapet 1 and the sealed edge of the roof membrane 7. Therefore, the mini-wall parapet 1 is fully protected from weather and moisture. In all of these embodiments, elements are shown with exaggerated spacing between the elements for clarity of disclosure. In actual structure, such spacing would be minimized.

Prior art FIG. 1B discloses a sheet metal variation of the mini-wall parapet 1. The wood planks 3 of FIG. 1A have been eliminated and replaced by the one-piece, generally U-shaped sheet metal structure 3. U-shaped sheet metal structure 3 can be prefabricated in the shop prior to installation at the site. The gage of the generally U-shaped structure 3 is chosen to have sufficient vertical strength to easily function as a mini-wall parapet. At the first step in its installation, the U-shaped member is still open at the top, whereby the structure can be easily attached along the roof edge at 17. As shown in FIG. 1B, the bottom wall member 22 is attached to the roof deck 2 by screws or masonry anchors 4, depending on the composition of deck 2. The lower left hand corner of the U-shaped member 3 is folded over on itself to form a double layer, and the double layer extends generally downwardly to form the cleat 11, Cleat 11 functions in the same manner as the cleat of prior art FIG. 1A. The cleat 11 is bent slightly outwardly at its lower edge as shown by element 13 in the same manner as in prior art FIG. 1A. If deemed necessary, cleat 11 can be further adhered to the edge of the roof deck 2 by the lateral fasteners 12.

At the top, opposite ends of the U-shaped element 3 are two staggered end elements 20 which are folded over as shown. The two folded over elements 20 are staggered vertically in height and sloped to receive the top member 8. The slope allows for the drainage of water toward the roof. Thus, when the top member 8 is installed, it performs the same general function as element 8 performs in prior art FIG. 1A. Top member 8 is attached to the U-shaped elements by screws 5. The top member 8 is of pressure treated plywood, and, although it can be prefabricated in the shop, it should be installed in the field to allow access to the interior of the U-shaped element 3 when it is fastened to the roof deck 2. The top member 8 can also be horizontal if desired, but such a configuration would not positively cause drainage toward the roof. The top member 8 can also be prefabricated of sheet metal, but plywood is preferred. Once the top member is installed, it provides even greater rigidity to the mini-wall parapet assembly. Further, the inner cavity of the mini-wall parapet 1 of prior art FIG. 1B can be filled with fiber glass, foam, mineral wool, or other insulation 27 to provide further thermal insulation if that is deemed necessary.

Thereafter, the membrane 7 and the coping member 10 are installed in the same manner as in FIG. 1A. The coping member 10, although of different shape from that used in FIG. 1A, is installed and functions in the same manner as coping member 10 in prior art FIG. 1A. The outward appearance of the mini-wall parapet of FIG. 1B from the ground, from an aesthetic standpoint, is virtually identical to that of FIG. 1A.

SUMMARY OF THE INVENTION

The object of this invention is to provide a sheet metal mini-wall parapet for sealing the roof membrane to the edge of a building which can be fully and inexpensively prefabricated off site which thus minimizes installation time and expense, whereby a superior seal is obtained while at the same time providing that seal for far less cost than conventional mini-wall parapet structures.

It is a further object of this invention to replace conventional wood plank mini-wall parapets with a sheet metal structure which is of much simpler construction, which is a much less expensive structure to manufacture and which is much quicker to install, and which provides a long-lasting and superior seal over conventional structures It is a further object of this invention to provide a mini-wall parapet which is not only inexpensive to make, it is easier to install, and it is aesthetically indistinguishable from conventional prior art mini-wall structures when viewed from the ground.

DESCRIPTION OF THE PREFERRED EMBODIMENTS

Figure 2A:
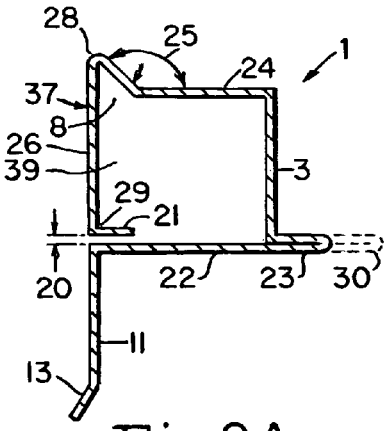
FIGS. 2(A-B) are directed to the first embodiment of our invention including sheet metal construction which can be fully prefabricated at the shop, and requires minimal installation time and expertise when installed at the roof site.

FIG. 2A is a cross-sectional end view of the first embodiment of our invention prior to installation as indicated by the element 1*a*. An end view of our sheet metal structure 1*a* is generally a four sided box shape in construction. Beginning at the bottom outside corner, a cleat 11 is shown which has a lower end which is bent out slightly at 13. The cleat 11 performs the same function that it performed in the prior art devices. The top of the cleat is bent 90 degrees to the right to form the horizontal bottom member 22 of our device. The bottom member 22 extends beyond the inside wall 3, and is folded over on itself to form a double layered extension 23. The double layered extension 23 provides the element used to attach the whole device to the roof deck. Therefore, layer 23 will be hereafter referred to as the attachment layer 23. The attachment layer 23 can be made as wide or as narrow as needed for proper attachment to the roof deck 2. See the dotted extension 30. Since the roof deck composition may vary, i.e., concrete, wood, or slotted steel, different widths for the attachment layer 23 may be necessary to assure a firm roof base for attachment.

Figure 1A:
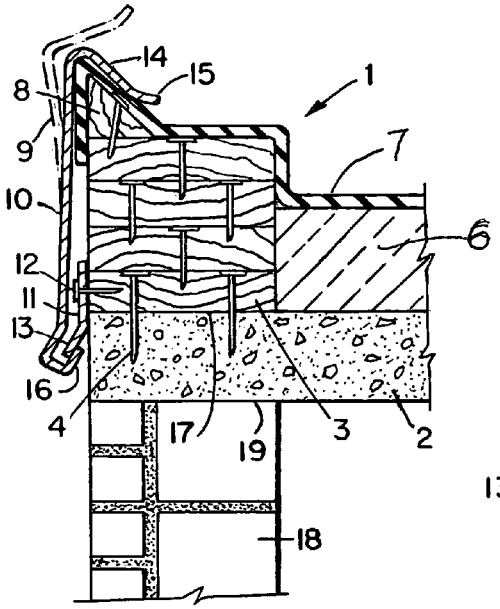
Fig.1A (PRIOR ART)
FIGS. 1(A-B) are directed to conventional prior art wood plank or sheet metal mini-wall parapets.

The top folded over layer of the attachment layer 23, is bent upwardly at 90 degrees at the appropriate point to form the inside right side wall 3 of the structure 1*a*. The sheet metal is again bent 90 degrees to the left at the appropriate height to form the top wall 24 of the structure 1*a*. At the appropriate point, the top wall is bent upwardly at an obtuse angle 25 to a point 28, where it is bent downwardly at an acute angle 37 to form the outer wall 26 which lines up with the bottom outside layer 11. The triangle 8 portion is not closed, but its upstanding generally triangular shape forms a gravel block 8 which functions in the same fashion as the gravel block 8 in FIG. 1A.

Outer wall 26 extends downwardly until it reaches point 29 where it is again bent 90 degrees to the right to form the lip 21. Lip 21 is of sufficient width so that it cannot be flexed past the bottom wall 22 when the coping member 10 (see FIG. 2B) is ultimately installed. Lip 21 is also spaced from the bottom member 22, as indicated by the gap 20, to provide room for a small amount of flexure when the coping member 10 is installed (again see FIG. 2B). Since, apart from the coping member 10, our device is of one-piece construction, the fabrication and installation procedures are minimal as compared with the prior art devices, above.

Figure 1B:
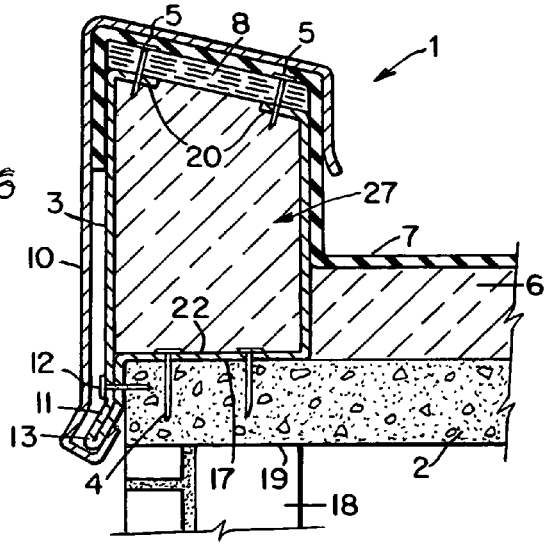
Fig.1B (PRIOR ART)
Figure 2B:
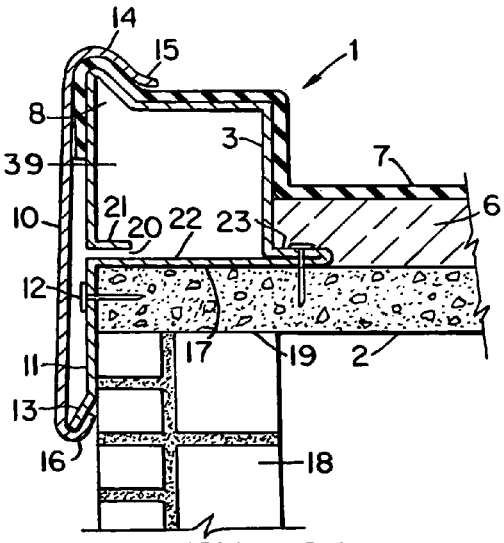

FIG. 2B discloses the sheet metal device 1*a* of FIG. 2A after it has been installed as the mini-wall parapet 1. The device 1 of FIG. 2A is attached to the roof deck 2 at the attachment layer 23 by the standard attachments 12, which can be either masonry attachments or screws dependent upon the composition of the roof deck 2. The structure 1 can be further secured through the cleat 11 laterally along the edge of the roof deck 2 by the attachments 12 in the same way that the prior art cleats were attached by the elements 12. The roof insulation layer 6 is installed on the roof deck 2 in the same manner as the prior art installations. Note that the folded attachment member 23 is shown in exaggerated thickness in FIG. 2B for purposes of disclosure, but its actual thickness is such that it does not significantly distort the insulation layer 6 when it is installed. The roof membrane 7 is installed over the device 1 of FIG. 2A in the same fashion as in the prior art devices, and it laps over the gravel guard 8, and partially down the outer wall 26 in the same manner as in the prior art. However, since the metal surfaces forming our mini-wall parapet are smooth, when the membrane is glued, it adheres more strongly in our structure than structures of the prior art. Thus, our fully metal structure resists tearing or separation from the structure as compared with the wood or partial wood devices of the prior art. As in the prior art FIG. 1B, our void 39 can be filled with insulation if necessary.

Finally with respect to FIG. 2B, our coping member 10 is installed in the same manner as with the prior art devices. As noted above, the gap 20 is provided to allow a slight flexure of the device when the coping member 10 is installed. In summary, therefore, our device is easier to make, easier to install, is more durable, adheres more strongly to the roof membrane, and thus, is an all around more desirable device as compared with the prior art.

Figure 3A:
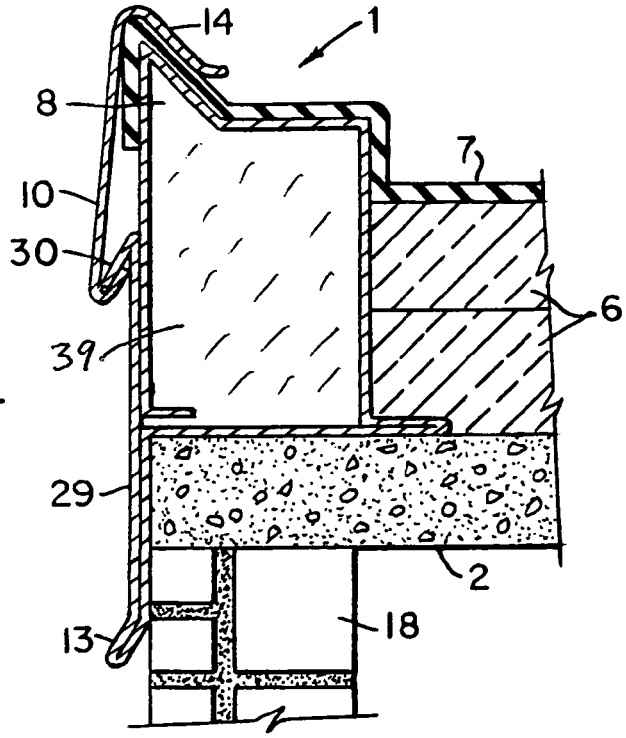
FIGS. 3(A-B) are directed to a second embodiment which is a variation of the embodiment of FIGS. 2(A-B). This embodiment allows for thicker insulation layers.
Figure 3B:
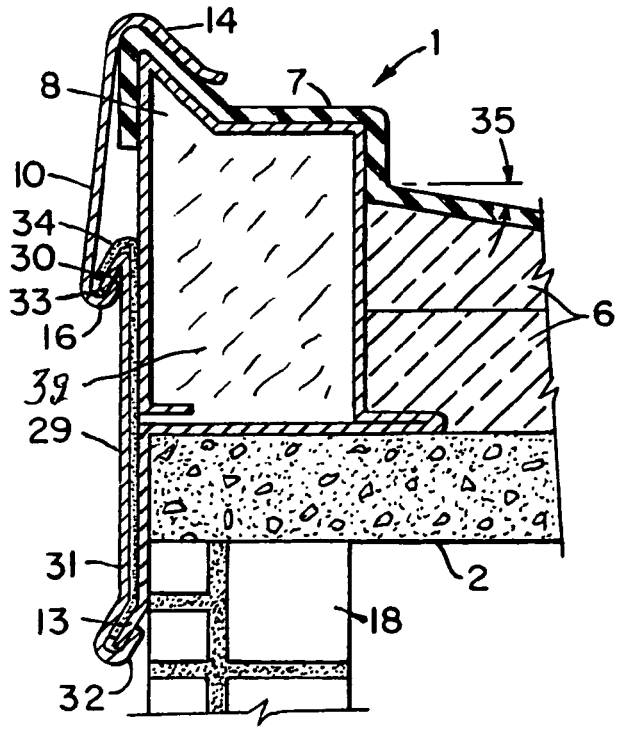

FIGS. 3(A-B) disclose variations of our mini-wall parapet over the invention of FIGS. 2(A-B). Only those elements necessary for full disclosure are specifically numbered to keep the disclosure uncluttered. Specifically, these embodiments accommodate those situations where the roof insulation layer 6 is made thicker for a variety of reasons. For example, in this environmentally sensitive day and age, it may be desired by certain "green" thinking people that the insulation must be thicker than usual so that energy loss through the roof is additionally minimized. A single thick layer 6, or multiple layers 6 may be utilized. A second layer 6 may be recommended where extremely hot or extremely cold climates exist. Still further, it is often desirable to drain water toward roof drains that are not adjacent to the mini-wall parapet so that the roof does not collect water in long-standing ponds near the parapet. Such ponds may promote insect growth or roof leakage that would not occur with a well drained roof. Well drained roofs also minimize ice dams that may develop in freezing temperatures. And, ice dams can also cause such long-standing ponds to collect. Therefore, roof drainage systems often use a tapered insulation layer (as indicated at 35 in FIG. 3B) to accomplish drainage.

In any case, the insulation layer may be much thicker next to the mini-wall parapet structure to facilitate draining water away from the mini-wall parapet. In those situations, the mini-wall parapet structure must be of increased height than those of FIGS. 2(A-B). In FIG. 3A, the structure of such an embodiment is disclosed as being quite similar to that of FIG. 2A. But note, that in this embodiment, two insulation layers 6 are shown so that the body of the structure must be at least that much taller than FIG. 2A. The coping member 10 of such a structure would have to have greater height as well. If it were simply a matter of making the coping member 10 taller, there would be no problem; but, since the coping member 10 may also be used as the decorative exterior facade for the mini-wall parapet, a problem arises which is termed in the art as "oil-canning." Oil-canning occurs when a tall, relatively thin layer of sheet metal is supported such that the weight of the metal itself causes it to sag minutely. Apparently, when viewed in the lateral direction, this minute sag causes the sheet metal to look uneven and unsightly. Therefore, oil-canning is undesirable from an aesthetic point of view. To obviate the oil-canning problem, the coping member 10 must be made shorter because oil canning does not noticeably occur when shorter coping members 10 are used. Clearly however, when significantly shorter coping members 10 are necessary, they will not reach between the cleat 11 and the gravel stop 8. Therefore, the metal forming the lip 13 is continued and doubled over to extend up the outside wall 26 as shown by the extension 29. (The doubled over cleat increases the strength of the cleat as well.) The top of this extension 29 is bent over again by an angle of approximately 135 degrees, forming a new cleat shown by the numeral 30. The new cleat 30 allows the coping member 10 to be the same, or near the same, height as used in FIGS. 2(A-B); and the coping member 10 operates in the usual fashion without experiencing oil canning.

FIG. 3B discloses and solves a further problem which may occur with the structure of FIG. 3A. When the coping member 10 is formed from a coated decorative metal, a mismatch may occur between the exterior coating on the coping member 10, and the exterior surface of extended wall 29. This mismatch may be unsightly. Therefore, a facade member 31 is provided. The facade member 31 is fabricated from the same material as the coping member 10, with the same matching exterior as the coping member 10. The bottom of the facade member 31 is bent into a hook 32 which engages the original cleat lip 13. The top of the facade member 31 is further bent downwardly to form a new lip 33 that fits snuggly behind the new cleat 30 of the extension member 29. Thereafter, when the coping member 10 is installed, the bottom lip 16 of the coping member 10 engages both the facade lip 33 and the cleat 30 simultaneously. When the coping member 10 is resiliently snapped over the gravel stop 8, as in the prior art, the matching facade member 31 is also locked into place. If this installation proves awkward to assemble, a double sided tape layer 34 under lip 33 can be used to temporarily hold the facade member 31 in place under the cleat 30 until the coping member 10 is snapped into place. In all other respects, the tall mini-wall parapet structure 1 is installed in the same fashion as in FIGS. 2B and 3A.

Each of the sheet metal structures in FIGS. 2(A-B) and 3(A-B) are fabricated in the lateral direction as elongated sheet metal structures which are of fixed length, but which may be fabricated of various lengths, dependent upon the needs of the installers. Alternatively, the various lengths can also be cut to length in the field as necessary. Further, the elongated sheet metal structures may be miter cut as needed, in the shop or in the field, to form either inside or outside corners as required. Finally, while the four walls of the sheet metal structure are generally fabricated as perpendicular, different angles other than strictly 90 degrees are contemplated. within the scope of the claimed invention Also, rounded corners, or even rounded sides, are also contemplated within the scope of the claimed invention. Finally, the vertical walls of these embodiments as recited in the claims are designated as "left hand" or "right hand" walls or "inside" or "outside" for ease of description, but these designations may be reversed dependent on from which end the structure is viewed.

Without further analysis, the foregoing so fully reveals the gist of the present invention that others can, by applying current knowledge, readily adapt it for various applications without omitting features that, from the standpoint of the prior art, fairly constitute essential characteristics of the generic and specific aspects of our contribution to the art, and therefore, such adaptations should and are intended to be comprehended within the meaning and range of equivalence of the appended claims.

We claim:

1. A mini-wall parapet structure comprising:

a. An elongated, generally box shaped in cross section, sheet metal structure;

b. Said elongated, generally box shaped in cross section, sheet metal structure having four walls, two generally horizontal wall members and two generally vertical wall members arranged in a generally perpendicular four sided box shaped fashion;

c. Said generally horizontal wall members comprising a bottom wall member and a top wall member for said elongated, generally box shaped in cross section, sheet metal structure;

d. Said generally vertical wall members comprising a left side wall member and a right side wall member for said elongated, generally box shaped in cross section, sheet metal structure;

e. Said elongated, generally box shaped in cross section, sheet metal structure includes a bottom left hand corner, a bottom right hand corner, a top right hand corner, and a top left hand corner;

f. Said bottom left hand corner of said elongated, generally box shaped in cross section, sheet metal structure extends vertically downward from said bottom left hand corner as a cleat for said mini-wall parapet structure;

g. Said bottom right hand corner extends horizontally from said bottom right hand corner as an attachment member for said elongated, generally box shaped in cross section, sheet metal structure;

h. Said attachment member further comprising a folded over portion which is extended horizontally back on itself to said bottom right hand corner;

i. The top layer of said folded over portion extends upwardly in a vertical direction from said bottom right hand corner to form said right hand wall member;

j. Said right hand wall member extends to said upper right hand corner, k. Said top wall member extends from said upper right hand corner in a generally horizontal direction, l. Said top wall member extends to and includes a generally triangular gravel stop portion at said top left hand corner, m. Said gravel stop portion comprising a generally right triangle portion which extends upwardly from said top member with the hypotenuse of said generally right triangle portion generally facing right, and the top of said hypotenuse forming the upper left hand corner of said elongated, generally box shaped in cross section, sheet metal structure;

n Said left hand wall member extends downwardly from said upper left hand corner to substantially close said elongated, generally box shaped in cross section, sheet metal structure.

2. A mini-wall parapet structure as recited in claim 1, wherein said cleat for said mini-wall parapet has its lower end turned out to form a lip which accepts a coping member when said mini-wall parapet structure is installed on a roof.

3. A mini-wall parapet structure as recited in claim 1, wherein said double layered attachment layer is used to adhere said mini-walled parapet structure to the edge of a roof deck in a lateral direction.

4. The mini-wall parapet structure as recited in claim 1, wherein said double layered attachment layer is variable in length to accommodate different roof deck materials.

5. A mini-wall parapet structure as recited in claim 1, wherein said elongated, generally box shaped in cross section, sheet metal structure is approximately square in cross section.

6. A mini-wall parapet structure as recited in claim 1, wherein said elongated, generally box shaped in cross section, sheet metal structure is approximately rectangular in cross section, and wherein the longer sides of said approximately rectangular in cross section, sheet metal structure are in the vertical direction.

7. A mini-wall parapet structure as recited in claim 1, wherein said folded over portion of said attachment layer increases the strength of said attachment layer.

8. A mini-wall parapet structure as recited in claim 1, wherein;

a. Said left hand wall member is terminated a small distance above said bottom left hand corner with a lip which extends inwardly, and wherein;

b. A separate coping member is employed when said mini-wall parapet structure is installed.

9. A mini-wall parapet structure as recited in claim 8, wherein:

a Said small distance above said bottom left hand corner allows a slight flexibility in said elongated, generally box shaped in cross section, sheet metal structure when said coping member is installed, and; wherein;

b. Said lip prevents said left hand wall member from sliding past said bottom left hand corner when said coping member is installed.

10. The mini-wall parapet structure as recited in claim 1, wherein said cleat for said mini-wall parapet structure may also act as a further attachment to the edge of the roof deck.

11. A mini-wall parapet structure comprising:

a. A one piece elongated, generally box shaped in cross section, sheet metal member; said mini-wall parapet structure formed from a single sheet of corrosion resistant material;

b. One lower outside corner further comprising a down directed extension from the bottom of said one piece elongated, generally box shaped in cross section, sheet metal member;

c. A horizontal extension of variable width from the opposite lower corner of said one piece, generally box shaped in cross section, sheet metal member;

d. Said horizontal extension of said one piece elongated, generally box shaped in cross section, sheet metal member is folded over on itself as a double layered attachment layer of variable width formed of a length, e. Said double layered attachment layer used for securing said mini-wall parapet structure to a roof deck requiring the length, f. The top layer of said double layered attachment layer extends upwardly at the inside lower corner as the vertical inner wall of sufficient height to accommodate an insulation layer of a thickness said one piece, generally box shaped in cross section, sheet metal member, g. Said vertical inner wall extends from an upper inside corner of said mini-wall parapet structure in the opposite direction from said double layered attachment layer, as the top member of said one piece, generally box shaped in cross section, sheet metal member;

h. Said top member extends in a downward direction at an upper outside corner as the vertical wall to substantially close said one piece generally box shaped in cross section, sheet metal.

12. A mini-wall parapet structure as recited in claim 11, wherein said down directed extension forms a cleat for said mini-wall parapet structure.

13. A mini-wall parapet structure as recited in claim 12, wherein said cleat for said mini-wall parapet has its lower end turned out to form a lip which accepts a coping member when said mini-wall parapet structure is installed on a roof.

14. A mini-wall parapet structure as recited in claim 12, wherein, said cleat is doubled over on itself and extends back up said left hand side wall member past said bottom left hand corner, and which terminates with a second cleat, sufficiently high on said left hand wall member.

15. A mini-wall parapet structure as recited in claim 14, wherein said thick insulation layer may comprise more than one layer of insulation.

16. A mini-wall parapet structure as recited in claim 15, wherein said thick insulation layer may comprise at least one tapered layer.

17. A mini-wall parapet structure as recited in claim 14, wherein, said cleat is doubled over on itself and extended back up said left hand side wall member past said bottom left hand corner, and which terminates with a second cleat, sufficiently high on said left hand wall member; and wherein a facade member, which matches the outer surface of said coping member, and which fits between said first cleat and said second cleat, is also locked is place when said coping member is installed.

18. The mini-wall parapet structure as recited in claim 12, wherein said cleat for said mini-wall parapet structure may also act as a further attachment to the edge of the roof deck.

19. A mini-wall parapet structure as recited in claim 11, wherein said one piece generally box shaped in cross section, sheet metal member is approximately square in cross section.

20. A mini-wall parapet structure as recited in claim 11, wherein said folded over portion of said attachment layer increases the strength of said attachment layer.

* * * * *